US007243823B2

(12) United States Patent
Cresap et al.

(10) Patent No.: US 7,243,823 B2
(45) Date of Patent: Jul. 17, 2007

(54) COLLAPSIBLE GARMENT HANGER WITH QUICK-RELEASE LEVER

(75) Inventors: Zachary R. Cresap, Gilbert, AZ (US); David P. Cresap, Gilbert, AZ (US)

(73) Assignee: Zadee Industries, LLC, Gilbert, AZ (US)

( * ) Notice: Subject to any disclaimer, the term of this patent is extended or adjusted under 35 U.S.C. 154(b) by 267 days.

(21) Appl. No.: 10/985,556

(22) Filed: Nov. 10, 2004

(65) Prior Publication Data

US 2006/0097018 A1 May 11, 2006

(51) Int. Cl.
*A41D 27/22* (2006.01)

(52) U.S. Cl. ..... 223/89; 223/85; 223/88; 223/93

(58) Field of Classification Search ..... 223/85, 223/88, 89, 90, 98; D6/315, 316, 318, 319, D6/328; 211/85.3
See application file for complete search history.

(56) References Cited

U.S. PATENT DOCUMENTS

| | | | | | |
|---|---|---|---|---|---|
| 320,230 | A | | 6/1885 | Donaldson | |
| 395,884 | A | | 1/1889 | Donaldson | |
| 765,331 | A | | 7/1904 | Batts | |
| 1,278,054 | A | * | 9/1918 | Strand | 223/89 |
| 2,232,249 | A | * | 2/1941 | Losin | 24/716 |
| 2,440,637 | A | * | 4/1948 | Lowe | 223/94 |
| 2,509,754 | A | | 5/1950 | Badalamenti | |
| 2,586,913 | A | * | 2/1952 | Burns | 223/94 |
| 2,712,890 | A | * | 7/1955 | Schaefer | 223/94 |
| 2,716,513 | A | * | 8/1955 | Braunstein | 223/94 |
| 2,724,533 | A | * | 11/1955 | Hansen | 223/94 |
| 2,777,621 | A | * | 1/1957 | Murray | 223/94 |
| 2,881,965 | A | * | 4/1959 | Fetko | 223/94 |
| 2,906,442 | A | | 9/1959 | McNutt | |
| 2,926,823 | A | * | 3/1960 | Weiser | 223/94 |
| 2,941,704 | A | | 6/1960 | Slutzky | |
| D189,897 | S | * | 3/1961 | Zifferblatt | D6/318 |
| 3,082,921 | A | * | 3/1963 | Sadowsky | 223/94 |
| 3,151,788 | A | * | 10/1964 | Wingate | 223/88 |
| 3,441,183 | A | * | 4/1969 | Chatkis | 223/94 |
| 3,531,028 | A | * | 9/1970 | Vazquez | 223/94 |
| 3,802,610 | A | * | 4/1974 | Love et al. | 223/94 |
| 3,858,770 | A | * | 1/1975 | Murray | 223/94 |
| 4,114,786 | A | | 9/1978 | Wiese | |
| 4,186,857 | A | | 2/1980 | Helms, Jr. | |
| 4,231,499 | A | * | 11/1980 | Smith | 223/94 |
| 4,524,890 | A | * | 6/1985 | Fulton | 223/94 |

(Continued)

FOREIGN PATENT DOCUMENTS

WO WO 03/013322 A1 * 2/2003

*Primary Examiner*—Gary L. Welch
*Assistant Examiner*—Nathan Durham
(74) *Attorney, Agent, or Firm*—The Hill Law Firm, PLC; Scott A. Hill

(57) ABSTRACT

The present invention is an apparel apparatus that is especially useful for hanging narrow or small necked shirts and sweaters. It is a collapsible garment hanger, or clothing hanger, that has moving parts. There are two hanger arms that rotate about pins on a hanger body, and there is a fulcrum about which a quick-release lever and release tabs pivot so that a locking mechanism can be manipulated. All of the parts used with the apparatus are inexpensive plastic parts that can be injection molded, and the apparatus can be quickly assembled by snapping parts together.

14 Claims, 2 Drawing Sheets

U.S. PATENT DOCUMENTS

| | | | | | |
|---|---|---|---|---|---|
| 4,565,309 | A | * | 1/1986 | Batts et al. | 223/96 |
| 4,673,115 | A | * | 6/1987 | LaMont | 223/94 |
| 4,730,757 | A | | 3/1988 | Keller | |
| 4,813,581 | A | * | 3/1989 | LaMont | 223/94 |
| 4,988,021 | A | * | 1/1991 | Adams et al. | 223/94 |
| 5,044,534 | A | | 9/1991 | Hwang | |
| 5,383,584 | A | * | 1/1995 | Adams | 223/94 |
| 5,397,037 | A | * | 3/1995 | Ozawa | 223/94 |
| 5,480,076 | A | | 1/1996 | Siegel et al. | |
| 5,590,823 | A | | 1/1997 | Lunde | |
| 5,613,627 | A | * | 3/1997 | Marks | 223/85 |
| 5,785,216 | A | * | 7/1998 | Gouldson et al. | 223/85 |
| 5,979,721 | A | * | 11/1999 | Curtis | 223/94 |
| 6,149,038 | A | * | 11/2000 | Tsai | 223/86 |
| 6,427,882 | B1 | | 8/2002 | Harvey | |
| 6,540,121 | B1 | | 4/2003 | Harvey | |
| 7,036,696 | B2 | * | 5/2006 | Lam | 223/94 |
| 2004/0211797 | A1 | * | 10/2004 | Landis et al. | 223/94 |

* cited by examiner

COLLAPSIBLE GARMENT HANGER WITH QUICK-RELEASE LEVER

BACKGROUND OF THE INVENTION

The majority of residences in the developed world have at least one closet full of articles of clothing on garment hangers. Using garment hangers for clothing storage provides easier viewing and access to clothing, and it is usually faster to hang clothing as opposed to folding. There are numerous different styles of garment hangers that meet budget constraints and clothing needs. People tend to invest more money on a garment hanger used with an expensive suit or jacket, but not for a shirt or sweater. Dress shirts, T-shirts, pull-overs and turtle necks frequently are placed on an inexpensive plastic or metal hanger. A problem that is often just tolerated is that the neck openings of these garments must be stretched or unbuttoned if the garment is removed from the hanger while it is still on a clothes rod. A closely related problem occurs when these garments are removed from the hanger by simply tugging on a shoulder of the garment until it stretches the neck opening over a hanger arm. The resulting spring force, when the garment is released from the hanger, commonly causes the hanger to be propelled off the clothes rod. Granted, all of these problems could be avoided if a person were to unhook the hanger and remove the garment by feeding the hanger down through the bottom of the garment, but this is awkward for most, and time consuming if the hanger snags on the inside of the garment while being removed.

Many have tried to develop a cost effective foldable or collapsible hanger that is easy to operate and will accommodate narrow-necked shirts and sweaters. Most of the prior art of the last 120 years is a variation of one or more of the following: the hanger arms are spring loaded and can temporarily be forced downwardly into a collapsed position, such as those described in U.S. Pat. Nos. 4,730,757, 4,813,581, 6,427,882, and 6,540,121; the hanger arms are spring loaded and can temporarily be forced laterally into a folded position, such as those described in U.S. Pat. Nos. 4,114,786, 4,988,021, and 5,480,076; or the hanger arms are normally in a locked position but can be released into a collapsed position, such as those described in U.S. Pat. Nos. 320,230, 395,884, 765,331, 2,509,754, 2,906,442, 2,941,704, 4,186,857, 4,231,499, 5,044,534, and 5,590,823. The first two variations are spring loaded devices, which can make them difficult to handle and control, so they present their own set of problems when a user attempts to insert and manipulate such a spring loaded garment hanger into the neck opening of a shirt. On the other hand, the garment hangers of the third variation frequently have many piece parts, are awkward to handle, or they are just too expensive to make available to the general public.

SUMMARY OF THE INVENTION

The present invention is an apparel apparatus, and more specifically a garment hanger that has arms that drop when a quick-release lever is squeezed. The preferred embodiment only requires three piece parts formed from just two injection molds, thereby creating a cost-competitive collapsible hanger that is easy to manufacture, assemble and use. In addition to low cost and easy use, a major focus of the present invention is extremely rapid removal of a garment from a hanger without damaging or stretching the garment. There isn't a return force that brings the hanger arms back to a locked position, so some of the clumsiness seen in the prior art devices has been eliminated. Also, the overall appearance of the collapsible hanger of the present invention is very familiar, and operation of the device is immediately obvious and natural for most.

The most preferred embodiment of the present invention requires a hanger body and two hanger arms that are interchangeable. The parts are injection molded plastic and can be snapped together in a few seconds. The hanger body has a base and a cover that are separated by a fulcrum, the separation defining a cavity. The hanger arms can rotate within the bottom section of the cavity, and the top section of the cavity is used to manipulate the cover so the hanger arms can be locked into position within the bottom of the cavity, or they can be released and allowed to fall into a collapsed position. There are several alternate embodiments that function the same way, with a release lever on the top of the cover that is squeezed to drop the hanger arms, but the piece parts and method of assembly are different.

Figure 1:
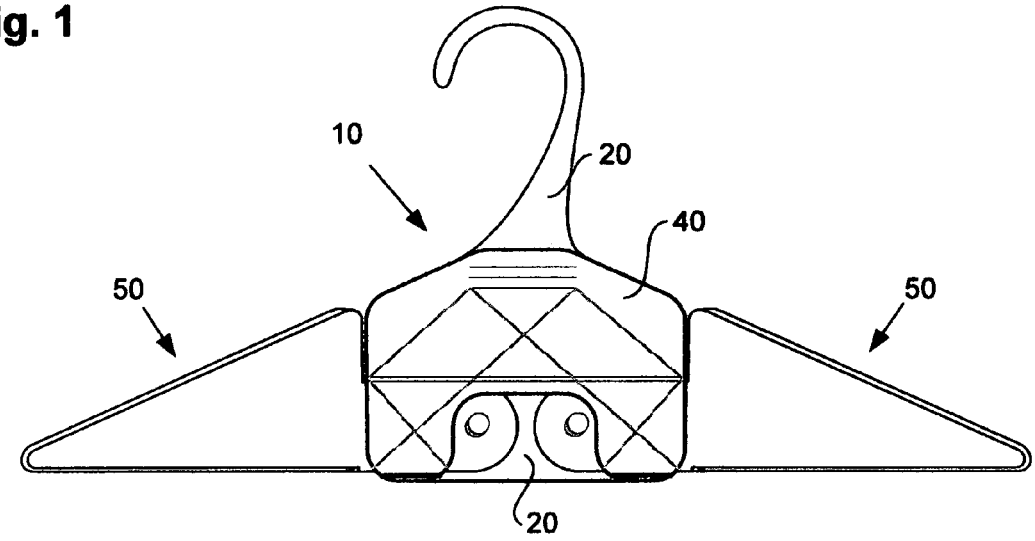
FIG. 1 is a perspective view of a collapsible hanger of the present invention—in the locked position.

The following is the list of numerical callouts used in FIGS. 1-4:

10 hanger body
20 base
22 hook
24 hanger neck
26 back
28 aperture
30 cavity
32 fulcrum
40 cover
42 quick-release lever
44 flange
46 release tab
48 teeth
50 hanger arm
52 broadened garment support
54 hanger shoulder
56 pin
58 distal tip
60 lateral reinforcement structure

DETAILED DESCRIPTION OF THE INVENTION

The most preferred embodiment of the present invention, shown in FIGS. 1 through 8, requires a hanger body 10 and two hanger arms 50. Because the two hanger arms are interchangeable, only two plastic piece parts need to be manufactured, preferably using an injection molding process. Assembly is easily accomplished by snapping two hanger arms into one hanger body. This specification will describe from the top to the bottom, as defined by FIG. 1, the preferred embodiment's hanger body and hanger arms, followed by assembly and function, and then alternate embodiments will be described. Preferred materials, shapes, methods of attachment and methods of assembly will be discussed, but these preferences are not intended to exclude suitable or functionally equivalent alternatives.

Figure 3:
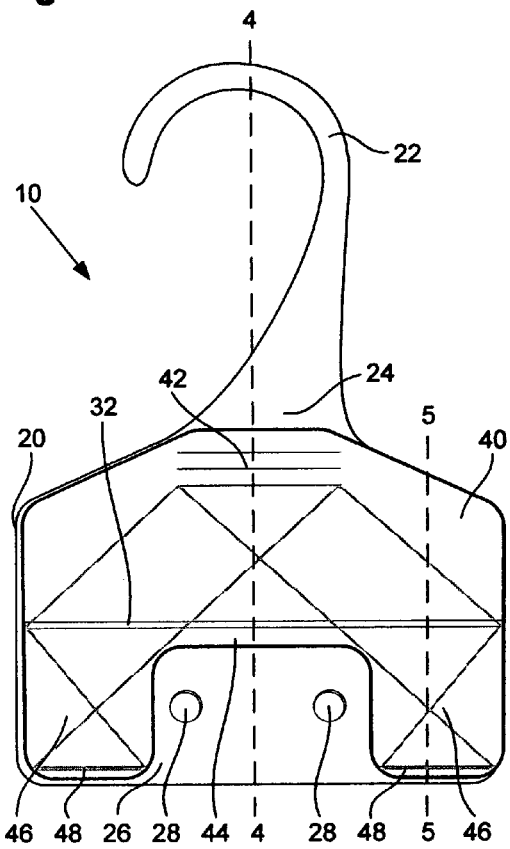
FIG. 3 is an enlarged perspective view of the hanger body used with the collapsible hanger of FIG. 1.
Figure 4:
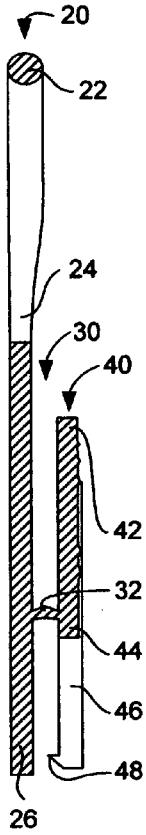
FIG. 4 is a cross section through line 4-4 of the hanger body of FIG. 3.
Figure 5:
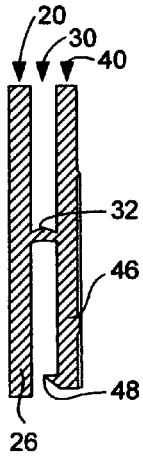
FIG. 5 is a cross section through line 5-5 of the hanger body of FIG. 3.

The hanger body 10 is comprised of three thicknesses: a base 20, a cavity 30 and a cover 40 (best seen in FIGS. 3-5). The base, from the top down, includes a hook 22, a hanger neck 24, a back 26 and apertures 28. The cavity includes a fulcrum 32 that holds the base in spaced relation to the cover such that a substantially uniform separation is normally maintained. The cover includes a quick-release lever 42, a flange 44, and release tabs 46 that have teeth 48 that project into the very bottom of the cavity. The least expensive and most preferred hanger body is molded from a strong and elastic material, preferably a thermoplastic or thermosetting polymer of high molecular weight, such as nylon.

As seen in FIG. 3, the base 20 of the hanger body 10 incorporates, at its top, a hook 22 that is similar in shape and size to the hooks on conventional clothing hangers designed to be supported by a pole or a rod. The thickness of the material at the hook will depend on the strength of plastic used to make the hanger body, but a common solid tubular nylon construction should have roughly a ten millimeter diameter, with the circular design of the hook having about a fifty millimeter diameter. Starting at about the base of the hook, the hanger neck 24 should broaden and flatten as it gets farther from the hook until it gradually meets a large flat structure that is the back 26 of the base. About three-quarters of the way down the back, there are two apertures 28 that are fairly symmetrically located on opposite sides of the vertical centerline 4-4 of the collapsible hanger (see FIG. 3). It should be noted that the vertical centerline passes through the center of the hook design's diameter.

As seen in FIGS. 4 and 5, the cavity 30 of the hanger body 10 lies just adjacent the back 26 of the hanger body. The cavity has a top section and a bottom section which are divided by a fulcrum 32. The fulcrum is most preferably molded as part of the base 20 and cover 40 such that it protrudes into the cavity from about the horizontal centerline of the back. The fulcrum is strong, elastic, and will recover its original shape after an applied squeezing force is released. Because the fulcrum will frequently be distorted, it may be necessary to include accordion-like bends or stress relief structures along the fulcrum's length to avoid premature failure. The fulcrum also determines the thickness of the cavity because the fulcrum acts to substantially hold the cover in a uniformly spaced relation to the base such that the base and cover normally lie in nearly parallel planes.

The cover 40 is similar to the base 20 in overall size, thickness, and flatness. The cover, like the cavity 30, is similarly divided by the fulcrum 32 into a top section and a bottom section. The top section of the cover, which is by function the quick-release lever 42, lies over the top section of the cavity. The bottom section of the cover, which lies over the bottom section of the cavity, has two release tabs 46 separated by a central flange 44 that is adjacent the fulcrum. The flange is for guiding the hanger arms 50 into the apertures 28 during assembly and use. Just below the flange is an open area in the bottom section of the cover that exposes the apertures in the back 26 of the hanger body. The release tabs, which are on the opposite side of the fulcrum as the quick-release lever, include teeth 48. The teeth point into the cavity and are beveled such that objects may easily enter the cavity, but not exit. Although there is only a single row of teeth shown in the various figures, one or more additional rows of teeth may be added adjacent the first row, along with corresponding ridges that should be molded into the hanger shoulder 54 of the arms so that the multiple rows of teeth can function together to hold the hangers arms in a locked position.

Figure 6:
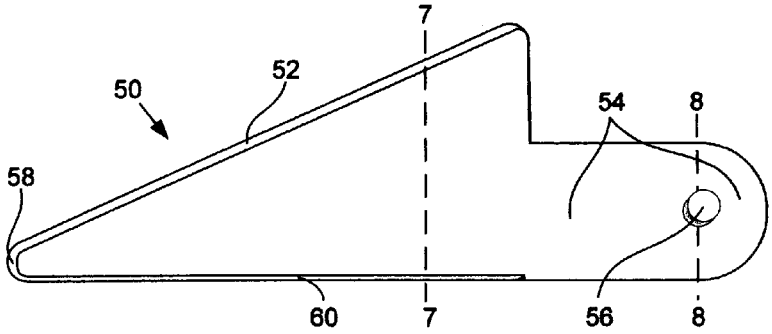
FIG. 6 is an enlarged perspective view of a hanger arm used with the collapsible hanger of FIG. 1.
Figure 7:
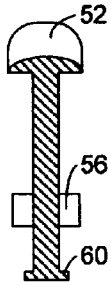
FIG. 7 is a cross section through line 7-7 of the hanger arm of FIG. 6.
Figure 8:
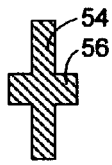
FIG. 8 is a cross section through line 8-8 of the hanger arm of FIG. 6.

As seen in FIGS. 6 through 8, the hanger arms 50, which are symmetrical and interchangeable, are the other molded part of the collapsible hanger of the present invention. The hanger arms are most preferably made from the same plastic as the hanger body 10. The top of a hanger arm is crested with a broadened garment support 52. A hanger arm has a hanger shoulder 54 that, at its center point, includes a pin 56 that extends outwardly from both major surfaces of the hanger shoulder. The hanger shoulder is rounded and smoothed to minimize friction, except along the bottom edge of the hanger shoulder. Farthest from the hanger shoulder is the distal tip 58. A lateral reinforcement structure 60 has been included on the bottom of the hanger arm, except under the hanger shoulder, to prevent it from bending under the weight of a heavy garment.

Figure 2:
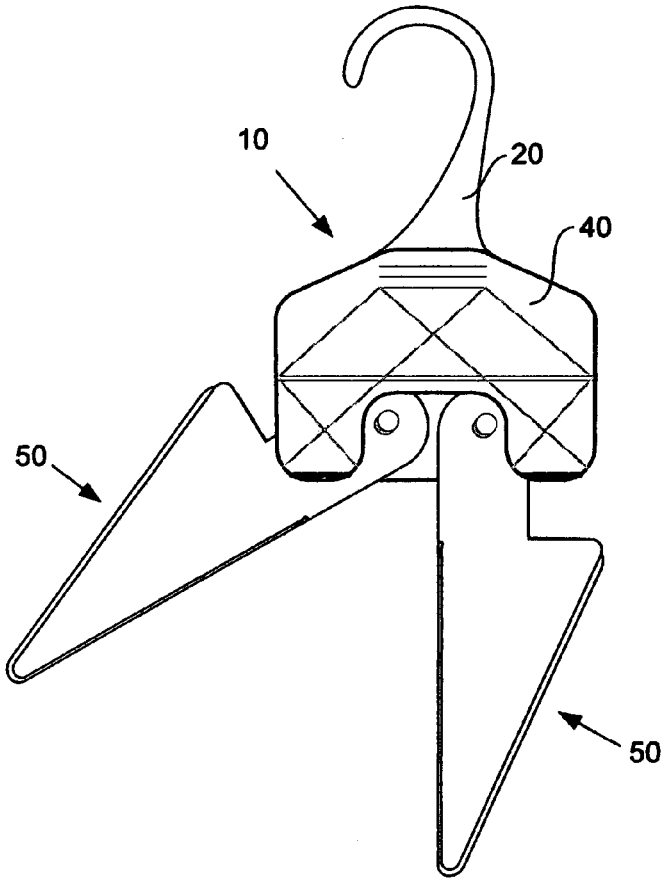
FIG. 2 is a perspective view of the collapsible hanger of FIG. 1 after the hanger arms have been released—in a collapsed position.

Assembly of a hanger is quickly accomplished by forcing the hanger shoulders 54 of two hanger arms 50, distal tips 58 pointing down, under the flange 44 of a hanger body 10 until the pins 56 snap into the apertures 28 such that each pin is rotateably joined with an aperture. The orientation only requires that the two hanger arm's lateral reinforcement structures 60 are adjacent each other, which places a just assembled hanger in the fully collapsed position. FIG. 2 shows the left hanger arm in a partially collapsed position, and the right hanger arm in the fully collapsed position. To bring the hanger arms into a locked position, which is the position a hanger must be in to support a garment, the distal tips are separated until each hanger shoulder has been rotationally moved into the bottom section of the cavity 30, under each of the release tabs 46. The teeth 48 will allow the hanger arms to move freely until the bottom edges of the hanger shoulders are independently gripped by the teeth into the locked position, which is the position shown in FIG. 1.

To operate an assembled collapsible hanger of the present invention, a user provide squeezing force is applied against the hanger neck 24 of the base 20 and the top of the quick-release lever 42. The applied force will temporarily distort the hanger body 10 at the fulcrum 32 and allow the quick-release lever to pivot about the fulcrum and travel through the top section of the cavity 30 toward the hanger neck. The base and cover 40 will substantially maintain their shape, but the fulcrum bends, so the release tabs 46 and quick-release lever work and move like the two ends of a seesaw. The relatively insignificant travel of the areas of the release tabs nearest the fulcrum, as well as the very limited travel of the flange 44, prevents the pins 56 from coming out of their apertures 28. The teeth 48, which are far away from the fulcrum, experience a significant amount of travel away from the back 26. The flange works to hold the hanger shoulders 54 against the base so that the rotationally joined pins and apertures do not separate. Conversely, the teeth pivot away from the hanger shoulder and back of the base until the hanger arms disengage from the locked position and drop under the force of gravity into the collapsed position. A shirt that was being held by the broadened garment supports 52 of the hanger arms 50 will fall off the collapsible hanger because the neck opening of the shirt will be much larger than the collapsed hanger by the time the distal tips 58 are adjacent each other. The hanger arms must be manually returned to the locked position.

There are numerous deviations from the above described preferred embodiment that are predominantly aesthetic, but nonetheless require minor changes in functional aspects. A first alternate embodiment is design to give the collapsible hanger of the present invention a sleeker, more aesthetic look that uses less material, but at the cost of some strength and stability. By compacting the hanger body, the hanger arms can be designed to look long and sleek, preferably with broadened garment supports that eliminate the need for the lateral reinforcement structures, which will give the hanger body with hanger arms an overall umbrella shape. A more compact hanger body will also allow the quick-release lever to be moved up, at least partially into the hanger neck, so the fulcrum can be positioned much closer to the hanger neck.

A second alternate embodiment uses a two piece hanger body that includes snap-fit fasteners, such as mushroom pins, that function to hold the cover piece to the base piece. The mushroom pins may be molded right into either the cover piece or the base piece, and the mushroom pins additionally serve the same purpose as the pins that were on the hanger shoulders of the preferred embodiment. In place of pins, the hanger shoulders have shoulder apertures through which the mushroom pins pass during assembly so the hanger arms are rotateably joined to and sandwiched between the cover piece and base piece. During operation, the top most edge of the hanger shoulder functions as the fulcrum about which the cover piece pivots, so there is no need to mold a fulcrum into the cover piece or base piece.

A third alternate embodiment, which is very similar to the preferred embodiment, has only one of the hanger arms rotateably joined to the hanger body, with the other hanger arm being permanently fixed or molded into the hanger body. Because the fulcrum serves just the one rotateably joined hanger arm, the fulcrum can be angled more towards being perpendicular to the required travel of the quick-release lever and release tab, which will put less stress on the fulcrum during operation of the collapsible hanger.

While a preferred form of the invention has been shown and described, it will be realized that alterations and modifications may be made thereto without departing from the scope of the following claims. For example: adding very broad distal tips that somewhat resemble upside-down spoons; including a non-slip cover or coating on the hanger arms; adding garment strap hooks to the hanger arms; supporting the hanger shoulders under the broadened garment supports rather than under the bottom edge of the hanger shoulders; or adding a swivel attachment to the hanger neck can be designed into the disclosed embodiments of the present invention by one skilled in the art. Also, it is advisable that unforgiving edges and corners be smoothed or shaped into a nearby structure to prevent a garment from getting caught or damaged unnecessarily.

What is claimed is:

1. A collapsible garment hanger comprising:

a one piece molded hanger body having a base and a cover that are separated by a cavity and held in spaced relation to each other by an elastic fulcrum, the base and the cover being substantially flat structures that substantially lie in parallel planes that are spaced by the cavity, the base including a hook at its top, a hanger neck and a back, the cover including a quick-release lever on the top of the fulcrum and release tabs on the bottom of the fulcrum, the fulcrum being part of the cover;

two hanger arms, each characterized on one end by a hanger shoulder that is rotationally joined to the hanger body, and each characterized on the opposite end by a distal tip;

a locked position, which places the hanger arms in a suitable position for supporting a garment, characterized by the hanger shoulders being supported by the release tabs;

a collapsed position, which allows the hanger arms to freely rotate, characterized by the hanger shoulders not being supported by the release tabs.

2. The collapsible garment hanger of claim 1 wherein each of the hanger shoulders, substantially at a center-point, is characterized by a pin; and wherein the back of the base is characterized by two apertures that are substantially symmetrically located on opposite sides of a vertical centerline of the collapsible garment hanger such that the hanger shoulders and the hanger body are rotationally joined when each of the apertures has received a pin from one of the hanger shoulders.

3. The collapsible garment hanger of claim 1 wherein the cover is characterized by a flange that lies adjacent the fulcrum between two release tabs, the flange helping to maintain the rotationally joined condition of the hanger arms.

4. The collapsible garment hanger of claim 1 further comprising teeth on the release tabs, the teeth substantially projecting into the cavity.

5. The collapsible garment hanger of claim 4 wherein a bottom edge of each hanger shoulder is independently gripped by the teeth when the collapsible garment hanger is in the locked position.

6. The collapsible garment hanger of claim 1 further comprising multiple rows of teeth along or near an edge of the release tabs, and corresponding rows of ridges along or near an edge of the hanger shoulders such that the rows of opposing teeth and ridges become interlocked and function together to hold the hangers arms in the locked position.

7. The collapsible garment hanger of claim 1 further comprising broadened garment supports that extend from the distal tips to points where the hanger arms meet the hanger body proximal to the hanger neck when the collapsible garment hanger is in the locked position such that a top edge of each hanger arm is structurally stronger and offers a crested surface area over which a garment may hang.

8. The collapsible garment hanger of claim 7 wherein the broadened garment supports have bottom edges that are gripped by the release tabs to hold the collapsible hanger in the locked position.

9. The collapsible garment hanger of claim 1 further comprising lateral reinforcement structures that extend from the distal tips to points that are proximal to the release tabs when the collapsible garment hanger is in the locked position such that each hanger arm is structurally stronger.

10. The collapsible garment hanger of claim 1 wherein the hanger body and hanger arms are molded and are at least partially comprised of nylon.

11. The collapsible garment hanger of claim 1 further comprising at least one stress relief structure along a length of the flexible fulcrum.

12. The collapsible garment hanger of claim 1 wherein the hanger arms are symmetrical and interchangeable.

13. A collapsible garment hanger comprising:

A two piece hanger body having a base piece and a cover piece that are separated by a cavity and held in spaced relation to each other by fasteners, the base piece including a hook at its top, a hanger neck and a back, the cover including a quick-release lever and release tabs;

two hanger arms, each characterized on one end by a hanger shoulder that is rotationally joined to the hanger body, and each characterized on the opposite end by a distal tip;

a locked position, which places the hanger arms in a suitable position for supporting a garment, characterized by the hanger shoulders being supported by the release tabs;

a collapsed position, which allows the hanger arms to freely rotate, characterized by the hanger shoulders not being supported by the release tabs;

wherein a squeezing force, when applied against the hanger neck and the quick-release lever, causes the cover to pivot at or near the fasteners and move the release tabs away from the hanger shoulders such that the collapsible garment hanger changes from the locked position to the collapsed position; and wherein the fasteners are molded into the hanger shoulders, substantially at a center-point, and wherein the back and the cover are characterized by apertures such that the hanger shoulders and the hanger body are rotationally joined by the fasteners, but the back and the cover are in a substantially fixed relation to each other.

14. A collapsible garment hanger comprising:

A two piece hanger body having a base piece and a cover piece that are separated by a cavity and held in spaced relation to each other by fasteners, the base piece including a hook at its top, a hanger neck and a back, the cover including a quick-release lever and release tabs;

two hanger arms, each characterized on one end by a hanger shoulder that is rotationally joined to the hanger body, and each characterized on the opposite end by a distal tip;

a locked position, which places the hanger arms in a suitable position for supporting a garment, characterized by the hanger shoulders being supported by the release tabs;

a collapsed position, which allows the hanger arms to freely rotate, characterized by the hanger shoulders not being supported by the release tabs;

wherein a squeezing force, when applied against the hanger neck and the quick-release lever, causes the cover to pivot at or near the fasteners and move the release tabs away from the hanger shoulders such that the collapsible garment hanger changes from the locked position to the collapsed position; and wherein the fasteners are molded into the back, and wherein the hanger shoulders and cover have apertures through which the fasteners pass such that the hanger arms are intermediate the base and the cover.

* * * * *